US009709361B2

(12) United States Patent
Barenz et al.

(10) Patent No.: US 9,709,361 B2
(45) Date of Patent: Jul. 18, 2017

(54) SEEKER HEAD FOR A GUIDED MISSILE AND METHOD OF DEPICTING AN OBJECT

(71) Applicant: DIEHL DEFENCE GMBH & CO. KG, Ueberlingen (DE)

(72) Inventors: Joachim Barenz, Ueberlingen (DE); Nicolai Kuenzner, Markdorf (DE); Hakan Kisakuerek, Munich (DE)

(73) Assignee: Diehl Defence GmbH & Co. KG, Ueberlingen (DE)

( * ) Notice: Subject to any disclaimer, the term of this patent is extended or adjusted under 35 U.S.C. 154(b) by 0 days.

(21) Appl. No.: 15/005,183

(22) Filed: Jan. 25, 2016

(65) Prior Publication Data

US 2016/0216074 A1 Jul. 28, 2016

(30) Foreign Application Priority Data

Jan. 23, 2015 (DE) ..... 10 2015 000 873

(51) Int. Cl.
*F41G 7/22* (2006.01)
*F41G 7/00* (2006.01)

(52) U.S. Cl.
CPC ..... *F41G 7/2213* (2013.01); *F41G 7/2253* (2013.01); *F41G 7/2293* (2013.01)

(58) Field of Classification Search
CPC . F41G 7/20; F41G 7/22; F41G 7/2213; F41G 7/2253; F41G 7/2273; F41G 7/2293
See application file for complete search history.

(56) References Cited

U.S. PATENT DOCUMENTS 4,717,822 A * 1/1988 Byren ..... F41G 7/2213 244/3.16
4,999,491 A * 3/1991 Semler ..... F41G 7/2213 250/233
5,077,465 A 12/1991 Wagner et al.
5,365,746 A 11/1994 Warner et al.
5,669,580 A * 9/1997 Strauss ..... F41G 7/2213 244/3.16
6,036,140 A * 3/2000 Tranapp ..... F41G 7/2213 244/3.16
6,978,965 B1 12/2005 Hartmann et al.
7,083,139 B2 8/2006 Broekaert
(Continued)

FOREIGN PATENT DOCUMENTS

DE 3925942 A1 2/1991
DE 19824899 C1 8/1999
DE 4331259 C1 7/2003
(Continued)

*Primary Examiner* — Bernarr Gregory
(74) *Attorney, Agent, or Firm* — Laurence A. Greenberg; Werner H. Stemer; Ralph E. Locher

(57) ABSTRACT

A seeker head for a guided missile has an outer casing, a detector unit with a matrix detector, and an optical system for depicting an object from an object scene surrounding the guided missile on the matrix detector. The optical system contains entrance optics and an optical link. The seek head further has a rolling-pitching system with a rolling frame and a pitching frame for aligning at least the entrance optics with the object. In order to be able to detect even objects that are far away and radiating weakly when the guided missile is rolling, it is proposed that the detector unit is arranged on the rolling frame for conjoint rolling.

15 Claims, 2 Drawing Sheets

(56) References Cited

U.S. PATENT DOCUMENTS

| | | | | |
|---|---|---|---|---|
| 8,927,914 | B2 * | 1/2015 | Eckhardt | F41G 7/2213 244/3.1 |
| 9,207,045 | B2 * | 12/2015 | Eckhardt | F41G 7/2213 |

FOREIGN PATENT DOCUMENTS

| | | | | | |
|---|---|---|---|---|---|
| DE | 10313136 | A1 | | 10/2004 | |
| DE | 102007030880 | A1 | | 1/2009 | |
| DE | 102007044766 | A1 | | 4/2009 | |
| DE | 102010055493 | A1 | | 6/2012 | |
| FR | 2830078 | A1 | | 3/2003 | |
| GB | 2153104 | A | * | 8/1985 | F41G 7/2213 |
| GB | 2322437 | A | * | 8/1998 | F41G 7/2213 |

* cited by examiner

SEEKER HEAD FOR A GUIDED MISSILE AND METHOD OF DEPICTING AN OBJECT

CROSS-REFERENCE TO RELATED APPLICATION

This application claims the priority, under 35 U.S.C. §119, of German application DE 10 2015 000 873.0, filed Jan. 23, 2015; the prior application is herewith incorporated by reference in its entirety.

BACKGROUND OF THE INVENTION

Field of the Invention

The invention relates to a seeker head for a guided missile with an outer casing, a detector unit with a matrix detector, an optical system for depicting an object from an object scene surrounding the guided missile on the detector containing entrance optics and an optical link and with a rolling-pitching system with a rolling frame and a pitching frame for aligning at least the entrance optics with the object.

Target-seeking guided missiles are equipped with a seeker head with entrance optics, which can be made to track the movement of a moving target. For this purpose, the entrance optics is movably mounted in relation to a dome of the guided missile or its outer casing and is driven in a motorized manner in such a way that it can be pivoted in a great angular range. Such a seeker optics is known from published, non-prosecuted German patent application DE 10 2010 055 493 A1.

For detecting targets that are located at a very great distance from the guided missile, very exact depiction with negligible image errors on an imaging unit, for example a matrix detector, is advantageous for allowing the target to be reliably detected as such even at a great distance.

SUMMARY OF THE INVENTION

A problem that is addressed by the present invention is that of providing a seeker head for a guided missile with which even objects that are small and far away can be located.

This problem is solved by a seeker head of the type mentioned at the beginning in which, according to the invention, the detector unit is arranged on the rolling frame for conjoint rolling.

The invention is based on the idea that a very sensitive seeker head is required for the optical detection of targets that are very far away and small. The sensitivity of a seeker head particularly depends on the exposure time of the detector system, that is to say for example the integration time of a matrix detector. The maximum possible exposure time for a sharp depiction of the object on the matrix detector depends in turn on the dynamics of the scene during the integration time, that is to say on the movement of the depicted image of the object over the detector area.

The invention is also based on the idea that it may be advantageous to allow a guided missile to roll about the axis of the missile during its flight. The seeker head, connected in a structurally fixed manner to the guided missile, rolls correspondingly with the body, and with it also a matrix detector that is arranged in a structurally fixed manner. In order to be able to follow for example an object that is situated somewhat to the side, the entrance optics of the seeker head that is aligned with it must be de-rolled, that is to say rotated at the same rolling rate counter to the rolling direction of the seeker head, so that it remains aligned locationally fixed in space. There is consequently a relative rotation between the entrance optics and a structurally fixed matrix detector. The object depicted by the optics on the sensitive area of the matrix detector also rotates correspondingly.

Depending on the rolling speed of the guided missile, this rotation causes blurring of the object scene, in particular at the periphery of the sensitive area of the matrix detector, so that details, such as point targets, can no longer be clearly detected there. As a result, the sensitivity of the seeker head falls, and consequently so does its optical range. Although image improving algorithms can reduce the image blurring in the peripheral region of the sensitive area of the matrix detector, they cannot reduce it completely enough to obtain a high degree of sensitivity of the seeker head when rolling takes place at high speed.

To solve this problem, the invention proposes the separation according to the invention of the matrix detector and the outer casing. By fastening the detector unit to the rolling frame, the matrix detector with the entrance optics rotates with the frame, so that the object depicted by it is also depicted in a point-stable form on the matrix detector when there is a de-rolling rotation of the entrance optics. As a result, the maximum integration time, and consequently the sensitivity of the seeker head, can then for example only be limited by the image refresh rate and no longer by the rolling of the guided missile. A highly sensitive seeker head for locating even objects that are small and far away can be realized.

The seeker head is advantageously arranged at the tip of the guided missile and in particular under a dome. The optical system expediently contains catadioptric optics with entrance optics and an optical link. The entrance optics contains in particular Cassegrain optics and expediently takes the form of mirror optics with a concave aspherical primary mirror and a convex aspherical secondary mirror. The primary mirror, that is to say the mirror on which the rays from the object scene first impinge, and the secondary mirror are expediently arranged in a pitching frame, and are consequently two-dimensionally pivotable about the rolling axis, which runs coaxially in relation to the axis of the missile or the axis of the seeker head, and a pitching axis.

The optical link expediently serves for correcting the beam on the matrix detector when there is a movement of the entrance optics. The optical link may be a mirror link with multiple mirror areas. Particularly advantageously, the optical link is a prism link with multiple reflective prisms. Four mirrors or reflective prism areas are expedient. A simple configuration of the optical link can be achieved if the beam from the entrance optics runs symmetrically in relation to the rolling axis and in relation to the pitching axis of the optics at least over a partial path within the optical link. At the transition from a primary part to a secondary part of the optical link, the beam expediently runs symmetrically in relation to the pitching axis.

The guided missile is expediently an actively propelled guided missile with a rocket engine and fins for controlling the flight and guiding the alignment of the guided missile. For this purpose, the guided missile, in particular the seeker head, is equipped with a control unit, which is prepared for guiding the guided missile in dependence on the signals of the matrix detector and for this purpose activates the fins of the guided missile.

The detector unit is arranged on the rolling frame for conjoint rolling, that is to say is fastened to the rolling frame in such a way that, with every rolling movement of the rolling frame, it rotates together with it. The matrix detector is expediently sensitive in the infrared spectral range, so that heat sources can be traced.

In order to suppress at least largely a thermally induced excitation of charge carriers in the matrix detector, and consequently noise of the matrix detector, in an advantageous refinement of the invention the seeker head contains a cooler for cooling the matrix detector. The operating temperature of the matrix detector is expediently cooled down during operation to a temperature of which the equivalent spectral range at the radiation maximum lies below the sensitive spectral range of the matrix detector in terms of energy.

In order to realize a short cooling-down time at a beginning of the operation of the matrix detector, a relatively voluminous cooler, for example a Joule-Thomson cooler, is necessary. Such a cooler would represent a great moment of inertia on the rolling axis if it were to roll conjointly with the detector unit. In order to avoid this, the cooler is expediently arranged rigidly in relation to the outer casing. When there is a rolling movement of the guided missile and a de-rolling movement of the entrance optics, the detector unit consequently rotates in relation to the cooler, but is otherwise expediently arranged immovably in relation to the cooler in the other spatial directions.

In order to achieve good cooling of the matrix detector, the cooler is expediently a gas cooler with a gas outlet, which is expediently aligned with the detector unit. Furthermore, the gas outlet is advantageously aligned parallel, in particular coaxial, to the rolling axis. During operation, cooling gas that has expanded and been cooled down by the expansion can be discharged from the gas outlet and impinge on the detector unit and cool it.

To allow the relative rotational movement between the matrix detector and the cooler, a gap may be arranged between these two units. In order to prevent excessive discharging of the cooling gas from a cooling gas volume, the gap is expediently sealed by a ceramic seal. Also possible is a silicone seal or a seal containing polytetrafluoroethylene (PTFE). The sealing areas of the seal are expediently pressed against one another in a prestressed manner. When there is a rolling movement, the two sealing areas rub against one another and thereby retain their sealing effect.

The image signals generated by the matrix detector are transmitted to a control unit for evaluation. The control unit is expediently arranged at least with one part, which performs the image evaluation and/or controls a rolling drive, in a structurally fixed manner in the seeker head, that is to say is fastened rigidly in relation to the outer casing. Due to the de-rolling movement, that is to say the relative rolling movement of the matrix detector in relation to the outer casing, it is necessary to transmit the data to the control unit by way of a communications unit that allows the rolling movement of the matrix detector.

The communications unit may be equipped with sliding contacts, which are guided by way of a slip ring. At a high data rate, it is advantageous to transmit the detector signals contactlessly. For this, the communications unit expediently contains a transmitter and a receiver for wireless data transmission between the transmitter and the receiver, in particular from the matrix detector to the control unit and/or the other way. The transmitter is for example fixed to the rolling frame and the receiver is fixed to the casing. One possibility for wireless data transmission may be inductive coupling, two conductor loops or antennas forming the transmitter and receiver. A capacitive coupling is also possible. Furthermore, an optical data transmission may also be considered for the wireless transmission of the data. Ideally, recourse is made to a known data transmission standard with a sufficient data rate, for example WLAN or WHDI.

Power is expediently supplied to the matrix detector by way of a slip ring. To this extent there is expediently a power supply device, which has a power store, a slip ring and a power line between the power store and the slip ring. The slip ring is expediently connected to a sliding element, which during a de-rolling movement runs around on the slip ring in a movable manner while maintaining contact. The sliding element is expediently wired to a power input of the detector unit.

If the guided missile rolls during its flight and the matrix detector is de-rolled in order to maintain a steady image of the object, the rolling frame is advantageously kept steady here with respect to the rolling movement in relation to the space outside the seeker head or in relation to the object scene. Or to put it another way: the absolute rolling rate of the rolling frame is eliminated. The absolute rolling rate may be understood here as constituting a geo-related rolling movement per unit of time, which is eliminated when the entrance optics is focused on an object that is immovable in relation to the seeker head.

The speed of the rolling movement of the outer casing, that is to say its rolling rate, is usually derived from a measured variable of a structurally fixed sensor, in order to bring about a counter-rolling of the rolling frame, that is to say its de-rolling, at the same speed by controlling a rolling drive, so that the absolute rolling rate of the entrance optics is eliminated. This may take place by using what is known as the "strap down principle", in which the rolling rate of the outer casing is concluded from a profile of an acceleration, and the rolling drive is thereby controlled.

As an alternative or in addition, there is the possibility that the absolute rolling rate of the rolling frame as such is detected by sensors, in particular by a rolling sensor fixed to the rolling frame. Then, with the aid of a sensor signal, the absolute rolling rate detected in this way can be controlled to zero or a desired rolling value.

In a further advantageous embodiment of the invention, for this the seeker head has a rolling sensor arranged fixed to the rolling frame for detecting a rolling movement of the rolling frame. The rolling sensor may be an acceleration sensor, for example a gyro sensor, a rotating rate sensor, an inertial sensor (IMU Inertial Measurement Unit) or the like. The arrangement fixed to the rolling frame, that is to say the rigid connection to the matrix detector, allows a rolling movement of the matrix detector and also a movement of the entrance optics rigidly coupled to the matrix detector with respect to the rolling to be measured.

The control of the rolling frame is expediently performed by a control unit for also controlling further drives of the seeker head, for example a pitching drive. The control unit may be identical to the control unit for guiding the missile during its flight and for controlling the seeker head functions.

In a further advantageous embodiment of the invention, the seeker head contains a movement sensor arranged fixed to the casing for detecting the movement of the outer casing. This allows a rolling rate to be determined and a rolling drive of the rolling frame to be activated or controlled in a closed-loop manner in such a way that it assumes a desired rolling value.

The invention is also directed to a method for depicting an object of an object scene on a matrix detector of a seeker head for a guided missile, in which an entrance optics of an optical system of the seeker head is aligned with the object with the aid of a rolling-pitching system, which has a rolling frame and a pitching frame, and the object is depicted on the matrix detector by the optical system.

A problem that is addressed by the invention directed to the method is that of providing a method with which a depiction even of a target that is small and far away on the matrix detector and a sensory detection of this target with the aid of the matrix detector can take place.

This problem is solved by a method of the aforementioned type in which according to the invention an outer casing of the seeker head rolls in relation to the object scene surrounding it about a rolling axis and the matrix detector rotates in relation to the outer casing and rolls conjointly with the rolling frame.

In an advantageous embodiment of the invention, the depiction of the object on the matrix detector is steady while the outer casing is rolling about the rolling axis. Expediently, the matrix detector is also steady in space, fixed to the roller frame. Such steadiness applies for example to a depicted object that is steady in relation to the rolling axis. When there is a movement of the object in relation to the seeker head, the depiction of the object may also move over the sensitive area of the matrix detector. Here the entrance optics is expediently made to track the moving object, the matrix detector thereby also expediently being corrected in its rolling movement. The alignment of the entrance optics with the object advantageously takes place by a rotation about two axes in relation to the axis of the missile, in particular a rolling axis and a pitching axis. The steadiness of the matrix detector in space, that is to say an elimination of the absolute rolling movement, can be achieved by driving the rolling frame counter to the rolling direction of the outer casing.

The matrix detector is expediently a detector that is sensitive in the infrared spectral range. In order to minimize as far as possible a thermally induced excitation of charge carriers in the matrix detector, and consequently noise of the matrix detector, the matrix detector is expediently cooled. For this, cooling gas is advantageously sprayed from a cooler of the seeker head that is fixed to the casing against a detector unit that has the matrix detector and turns in relation to the cooler about the rolling axis.

In order to allow a stable alignment of the entrance optics with the object, in a further advantageous refinement of the invention it is proposed that a rolling rate of the rolling frame is detected by a rolling sensor arranged fixed to the rolling frame. Expediently, the rolling rate is controlled to a desired rolling value with the aid of the data of the rolling sensor. The control may contain a closed-loop control, so that the rolling value is controlled in a closed-loop manner to the desired rolling value. The rolling rate here may be the absolute rolling rate, that is to say a rotational rolling speed in relation to the object scene.

A further advantageous refinement of the invention provides that a rolling rate of the outer casing is determined with the aid of a movement sensor fixed to the outer casing. The movement sensor is expediently an inertial sensor, in particular an acceleration sensor or a rotating rate sensor. With the aid of the determined value of the rolling rate, a rolling drive may be activated, so that the rolling frame is rotated in relation to the outer casing counter to its rotational rolling direction. The rolling rate of the rolling frame is therefore reduced as a result. Also in this way, the rolling rate of the rolling frame can be controlled to a desired rolling value.

Depending on the accuracy of the movement sensor, it may happen that the rolling frame rolls with a residual rolling rate, that is to say is not quite steady in space and free from any rolling. Such a residual absolute rolling rate may be detected with the aid of a rolling sensor arranged fixed to the rolling frame. Expediently, the rolling rate is controlled, in particular in a closed-loop manner, to a desired rolling value with the aid of the data of the rolling sensor. This control advantageously takes place with data both of the movement sensor and of the rolling sensor.

In order to be able to detect even rapid movements of the rolling frame, it is advantageous if the rolling sensor is a sensor which can reliably detect even very rapid movements. However, it may be advisable here for reasons of cost and/or weight to use a simpler sensor, with which it may happen that over the course of time it has a measuring error, in particular a cumulative measuring error, for example in the form of a drift. In order to reduce this at least partially, it is proposed that, when controlling the rolling rate to the desired rolling value, a measuring error of a rolling sensor fixed to the rolling frame is at least partially detected with the aid of a movement sensor fixed to the casing and taken into account. If, for example, there is a measuring error of the rolling sensor that fluctuates greatly over time, this can be detected by the stationary movement sensor and/or be at least partially compensated.

When there is a movement of the object, in particular a rapid movement about the seeker head, the entrance optics expediently remains aligned with the object. The rolling frame rolls correspondingly, in order to allow such tracking of the object by the entrance optics. Hereinafter, such rolling is referred to as the rolling movement, so that even with a rolling rate of zero a rolling movement is possible, but is caused by making the entrance optics track an object moving about the rolling axis. Such a rolling movement may be very rapid, in particular if the object moves through or in the vicinity of the rolling axis. In order even here to keep the absolute rolling rate stable at the desired rolling value, it is advantageous if, in addition to the rolling rate of the rolling frame, a rolling movement that is produced by a tracking of the object by the entrance optics is detected with the aid of the rolling sensor.

Expediently, the rolling drive is controlled in such a way that a rolling rate of the rolling frame is controlled, in particular in a closed-loop manner, to the desired rolling value with the aid of the rolling movement activated for the tracking of the object and with the aid of the data of the rolling sensor. The movement of the depiction of the object on the sensitive area of the matrix detector can be reliably used here for the evaluation of the movement of the object in relation to the seeker head or the rolling axis.

A further possibility for controlling the absolute rolling rate to a desired value is that a rolling rate of the rolling frame is determined with the aid of data obtained from a depiction of the object scene on the matrix detector. The rolling drive can be activated correspondingly and the rolling rate controlled to a desired rolling value, in particular in a closed-loop manner.

The description given so far of advantageous refinements of the invention includes numerous features that are reproduced in the individual dependent claims, in some cases combined into groups. However, these features may expediently also be considered individually and combined into appropriate further combinations. In particular, these features can each be combined individually and in any suitable combination both with the method according to the invention and with the device according to the invention in accordance with the independent claims. Thus, method features may also be regarded as worded in substantive terms as characteristics of the corresponding device unit and vice versa. For example, the control unit is suitable and prepared for carrying out corresponding method features.

The characteristics, features and advantages of this invention and the manner in which they are achieved will be more clearly and distinctly comprehensible in conjunction with the following description of the exemplary embodiments, which are explained in greater detail in conjunction with the drawings. The exemplary embodiments are used to explain the invention and do not restrict the invention to the combination of features, including functional features, that is specified therein. For this purpose, it is furthermore also possible for suitable features of each exemplary embodiment to be considered explicitly in isolation, removed from one exemplary embodiment, introduced into another exemplary embodiment in order to supplement the latter and/or combined with any one of the claims.

Other features which are considered as characteristic for the invention are set forth in the appended claims.

Although the invention is illustrated and described herein as embodied in a seeker head for a guided missile, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
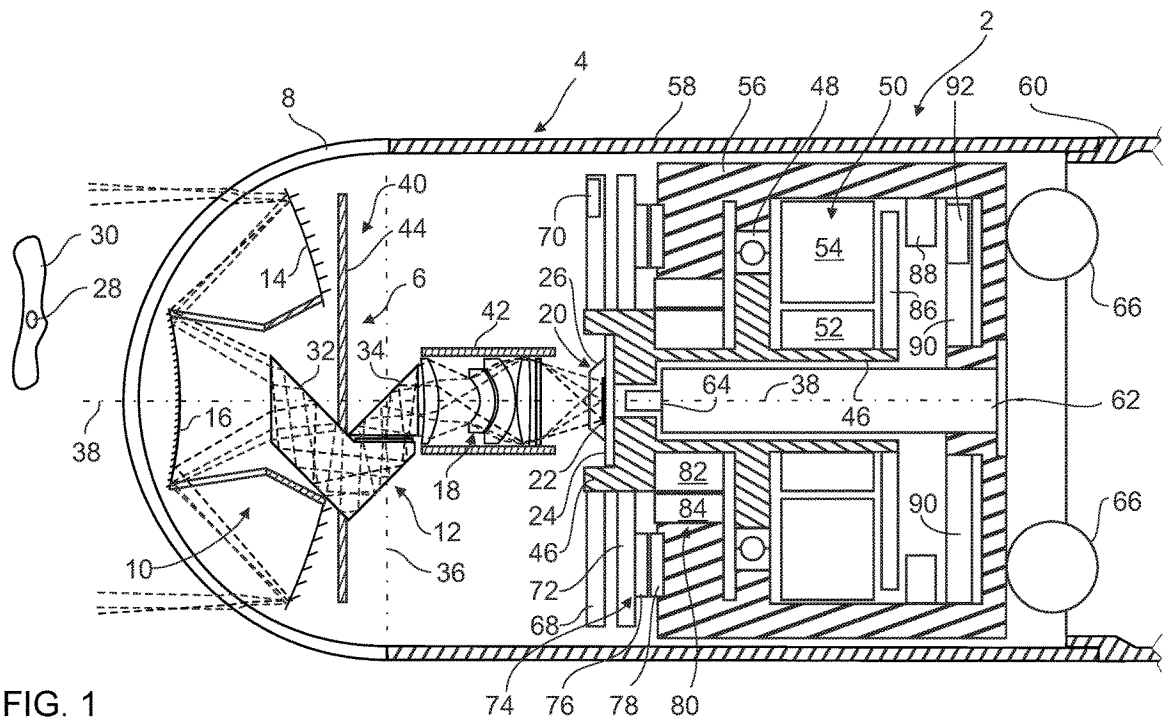
FIG. 1 is a diagrammatic, longitudinal sectional view through a front part of a guided missile with a seeker head according to the invention.

Referring now to the figures of the drawings in detail and first, particularly to FIG. 1 thereof, there is shown a front part of a guided missile 2 in a schematic longitudinal section, and there in particular a seeker head 4 at a tip of the guided missile 2. The seeker head 4 is equipped with an optical system 6, which is arranged directly behind a dome 8 in a forward most tip of the seeker head 4. The optical system 6 contains a Cassegrain optics with entrance optics 10 and an optical link 12. The entrance optics 10 includes a concave primary mirror 14 and a convex secondary mirror 16. By way of the optical link 12, the entrance optics 10 is optically connected by way of a detector optics 18 to a detector unit 20, which has a matrix detector 22 on a carrier 24 in a detector housing 26. An object 28 of an object scene 30 is depicted on the matrix detector 22 by way of the entrance optics 10, the optical link 12 and the detector optics 18.

The optical link 12 is formed by two prism blocks 32, 34, which are configured movably in relation to one another. Here, the first prism block 32 is pivotable in relation to the second prism block 34 about a pitching axis 36 and both prism blocks 32, 34 are rotatable about a rolling axis 38, which runs in the axial direction or the longitudinal axis of the guided missile 2. The first prism block 32 is fixedly connected to the entrance optics 10, so that the latter can be turned about the pitching axis 36 and a rolling axis 38. The second prism block 34 is fixedly connected to the detector optics 18 and the detector unit 20, so that during the operation of the seeker head 4 these units are only rotatable about the rolling axis 38.

The entire optical system 6 is consequently mounted in a rolling-pitching system 40, the rolling frame 42 and pitching frame 44 of which are only schematically represented in FIG. 1. The rolling frame 42 carries all of the rotatable elements of the optical system 6, that is to say also the pitchable elements, and is rigidly fastened to a rotor block 46. The pitching frame 44 carries all of the pitchable elements, such as the entrance optics 10 and the prism block 32.

A detector unit 20 is likewise fixed to a rotor block 46, which is rotatable about the rolling axis 38 with the aid of a rolling drive 50, which has a rotor 52 and a stator 54. By way of a bearing 48, the rotor block 46 is held in a stator block 56, which is rigidly fastened to the outer housing 58 of the seeker head 4 and the outer housing 60 behind it of the remaining guided missile 2. Fastened to the rear part of the stator block 56 is a cooler 62 with a forwardly directed gas outlet 64, which is aligned with the detector unit 20 and opens directly behind the latter in the direction thereof. The cooler 62 is supplied with gas during the operation of the seeker head 4 by way of two gas containers 66.

Likewise rigidly connected to the rotor block 46, and consequently rotatable about the rolling axis 38 are a pitching electronics unit 68, a rolling sensor 70, a detector electronics unit 72 and a communications unit 74 with a transmitter 76 and a receiver 78. The transmitter 76 may also act as a receiver and the receiver 78 may also act as a transmitter, so that a bidirectional communication is possible. The transmitter 76 and the receiver 78 are configured as annular discs, and the transmitter 76 is rigidly connected to the rotor block 46 and the receiver 78 is rigidly connected to the stator block 56.

The rotor block 46 also carries an energy transmission unit 80 with a slip ring 82 and a brush 84 for the transmission of electrical energy from an energy store fixed to the housing and not represented to the detector unit 20. Here, the slip ring 82 is wired to the detector unit 20 and the brush 84 is wired to the energy store. Also connected to the rotor block 46 is an optical grating 86, with the aid of which the rotational speed of the rotor block 46 in relation to the stator block 56 can be determined by way of an optical scanner 88 of a control unit 90 fixed to the casing. The rolling rate of the stator block 56 or of the outer casing 58 can be detected by the control unit 90 by way of a movement sensor 92, which is likewise fixed to the casing, and which is configured as an inertial sensor or IMU (Inertial Measurement Unit). For this purpose, the movement sensor 92 detects acceleration values, for example a centrifugal acceleration and/or accelerations in further spatial directions, and thereby determines from an initial state a later momentary state, for example a rolling rate, a flying speed and possibly other further variables.

The guided missile 2 is a missile that is self-propelled and can be guided by way of rudders that are not represented and is for example launched from a canister. Using its rocket engine, the guided missile 2 flies in the direction of a prescribed target, which is for example stored in the control unit 90 or some other control unit, for example with the aid of coordinates. It is likewise possible to prescribe an optical target, for example the object 28, which is optically detected and is transmitted to a corresponding control unit 90 before or after the launching of the guided missile 2. During the approach to the object 28, it is depicted on the matrix detector 22 by way of the optical system 6. A movement of the depicted image of the object 28 on the sensitive area of the matrix detector 22 first leads to a movement of the entrance optics 10, so that the latter remains aligned with the object 28 in as centered a manner as possible. Second, the movement leads to a steering command for aligning the longitudinal axis of the guided missile 2 in the direction of the object 28, so that the guided missile 2 in this way tracks the object 28.

Before the activation of the matrix detector 22, it is cooled down by the cooler 62 to a temperature at which a thermally induced excitation of charge carriers in the matrix detector 22, and consequently noise of the matrix detector 22 in the infrared spectral range, is greatly reduced in comparison with room temperature, so that even optics of the object scene 30 that radiate weakly in the infrared, and in particular the aimed—for object 28, are detected. For this, cooling gas that has expanded within the cooler 62 and thereby cooled down greatly is blown through the gas outlet 64 onto the rear side of the carrier 24, so that the latter, and with it the matrix detector 22, cool down greatly. The gas distributes itself in the gap between the rotor block 46 and the cooler 62 in the rearward direction and is carried away there.

It may happen during the flight of the guided missile 2 that it rolls about its rolling axis 38. Rolling rates in excess of 1 Hz may occur thereby. Without de-rolling of the rolling frame 42 or of the rotor block 46, the field of view of the entrance optics 10 would rotate at this frequency and focusing on the object 28 would only be possible with an alignment of the entrance optics 10 exactly in the direction of the rolling axis. In order nevertheless to allow exact lateral focusing of the entrance optics 10 on the object 28, the rolling rate of the outer casing 58 or of the stator block 56 is detected by the movement sensor 92. On the basis of the data of the movement sensor 92, the control unit 90 activates the rolling drive 50, so that the rolling frame 42 rotates counter to the rolling direction of the outer casing 58 and at the rolling rate determined by the movement sensor 92. As a result, the rolling frame 42 de-rolls and is steady in space with the outer casing 58 rotating around it. The alignment of the detector optics 18 in space is correspondingly steady—apart from changes caused by the flying speed and possibly changes in direction of the guided missile 2—and also the depiction of the object 28 is steady, when there is no movement of the object 28 itself, on the sensitive area of the matrix detector 22.

An alternative de-rolling method may be carried out with the aid of the rolling sensor 70. The latter can also detect a rolling rate of the rolling frame 42, so that the control unit 90, which is connected in data terms to the rolling sensor 70 by way of the communications unit 74, can control a de-rolling of the rolling frame 42 by the corresponding activation of the rolling drive 50. In the case of this method, there is also the possibility of controlling the rolling rate of the rolling frame 42 in a closed-loop manner. The controlled variable here is for example a measured centrifugal acceleration that acts on the rolling sensor 70. The thrust of the rolling drive 50 is controlled by the control unit 92 in such a way that the centrifugal force, and consequently the absolute rolling rate, are for example controlled to zero in a closed-loop manner.

A further method is that of the movement sensor 92 interacting with the rolling sensor 70 for controlling the absolute rolling rate of the rolling frame 42 to a desired rolling value, for example to zero. For this purpose, the absolute rolling rate is controlled with the aid of the control unit 90 and the movement sensor 92 in the way described with respect to the first method. In principle, the rolling sensor 70 would have to confirm the desired absolute rolling rate. If this is not the case, the signal of the rolling sensor 70 may be used as an additional signal by the control unit 90, in order to set the desired absolute rolling rate of the rolling frame 42. The de-rolling consequently consists of two components: a component resulting from the signal of the movement sensor 92 and a component resulting from the signal of the rolling sensor 70 and added to the first component.

When there is a rapid movement of the object 28 transversely in relation to the rolling axis 38, in particular when moving past very close to the rolling axis 38, the tracking of the object 28 by the entrance optics 10 can lead to a very sudden and very rapid rolling movement of the rolling frame 42. The rolling movement is a movement that is detected in addition to the rotation of the rolling frame 42 by the rolling sensor 70. The rolling sensor 70 is prepared for this, and is consequently a very rapidly detecting sensor, which is capable of accurately detecting rapid movements and rapid changes in movement. Since the rolling movement of the rolling frame 42 for the tracking of the entrance optics 10 is controlled by the control unit 90 and monitored with the aid of the optical grating 86, the control unit 90 can also separate this rolling movement from the de-rolling movement of the rolling frame 42 out of the signal of the rolling sensor 70. Control of the de-rolling rotation still remains possible.

In a further method it may happen that the measurements of the rolling sensor 70 are affected by a measuring inaccuracy. For example, a multiplicity of fluctuating accelerations may give rise to a cumulative drift, which may result in a rolling measuring error. Such a measuring error can be detected by the control unit 90 with the aid of the data of the movement sensor 92. The movement sensor 92 rotates relatively constantly at the rolling rate of the outer casing 58, and its possible measuring error can be detected by the control unit 90 through the signal of the rolling sensor 70 and be compensated. If measuring errors of the rolling sensor 70, for example caused by strong corrective guiding accelerations of the entrance optics 10, occur later, these errors can be detected through the data of the movement sensor 92 and be compensated by the control unit 90, since the latter is not stressed as severely during the time of the strong deflection of the entrance optics 10 and delivers more accurate measurement results.

It goes without saying that it is also possible to combine individual components of the described methods for controlling the rolling rate to a desired rolling value, in particular in a closed-loop manner.

Figure 2:
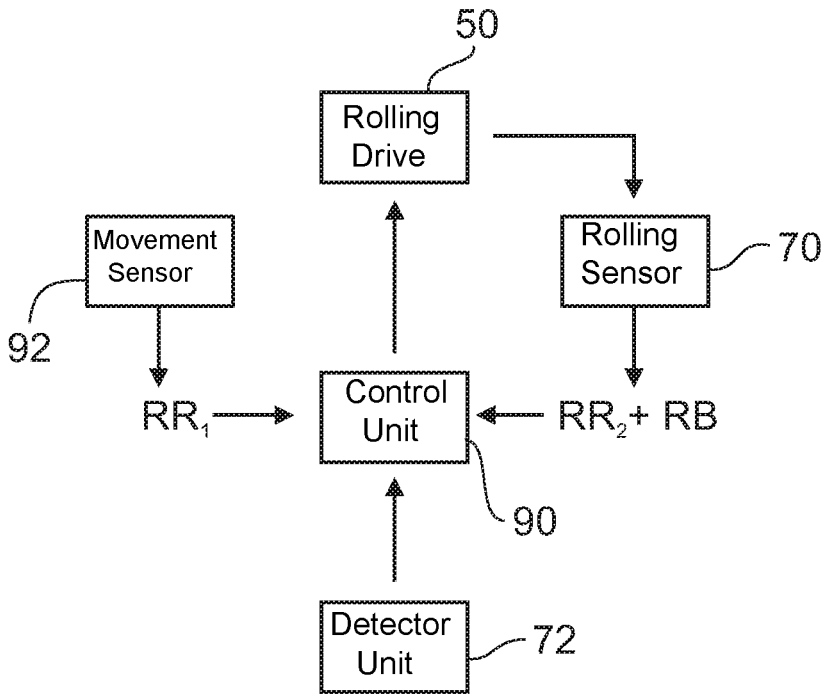
FIG. 2 is a flow diagram of a method for de rolling entrance optics.

A corresponding method sequence is represented by way of example in FIG. 2. The movement sensor 92 detects a first rolling rate RR1 and delivers the corresponding data to the control unit 90. The latter activates the rolling drive 50 for de-rolling the rolling frame 42.

A residual rolling rate RR2 is detected by the rolling sensor 70, which feeds its data to the control unit 90. With the aid of this correction data, the rolling drive 50 is likewise activated, so that more accurate de-rolling takes place. This is detected in a control loop of the rolling sensor 70 and used by the control unit 90 for the closed-loop control.

A movement of the depiction of the object 28 on the sensitive area of the matrix detector 22 is detected by the detector electronics unit 72 and corresponding data are delivered to the control unit 90. The latter controls the tracking of the entrance optics 10 to the object 28, so that an additional rolling movement RB of the rolling frame 42 is produced, and this is added to the desired rolling rate. The rolling movement RB is also detected by the rolling sensor 70 and the corresponding signal is passed on to the control unit 90. The latter separates out of the signal the two movements, to be specific separates the residual rolling rate RR2 from the rolling movement RB, and also activates the rolling drive 50 such a way that the residual rolling rate RR2 is eliminated or assumes a desired value.

Depending on the nature of the object scene 30, its depicted image on the sensitive area of the matrix detector 22 may likewise be used for setting the absolute rolling rate. If, for example, the horizon, the sun and/or some other known object that is stable in its position, is depicted, its depicted image on the sensitive area of the matrix detector 22 is steady when there is an eliminated rolling rate of the rolling frame 42 and a straight flight of the guided missile 2. The rolling of the rotor block 46 or of the rolling frame 42 can be detected through a circling of the depicted image on the matrix detector 22 for example by image detection. This circling can be used for controlling the absolute rolling rate.

The following is a summary list of reference numerals and the corresponding structure used in the above description of the invention:

2 guided missile
4 seeker head
6 optical system
8 dome
10 entrance optics
12 optical link
14 primary mirror
16 secondary mirror
18 detector optics
20 detector unit
22 matrix detector
24 carrier
26 detector housing
28 object
30 object scene
32 prism block
34 prism block
36 pitching axis
38 rolling axis
40 rolling-pitching system
42 rolling frame
44 pitching frame
46 rotor block
48 bearing
50 rolling drive
52 rotor
54 stator
56 stator block
58 outer casing
60 outer casing
62 cooler
64 gas outlet
66 gas container
68 pitching electronics unit
70 rolling sensor
72 detector electronics unit
74 communications unit
76 transmitter
78 receiver
80 energy transmission unit
82 slip ring
84 brush
86 optical grating
88 scanner
90 control unit
92 movement sensor
RB rolling movement
RR1 rolling rate
RR2 residual rolling rate

The invention claimed is:

1. A seeker head for a guided missile, the seeker head comprising:
- an outer casing;
- a detector unit having a matrix detector;
- an optical system for depicting an object from an object scene surrounding the guided missile on said matrix detector, said optical system having entrance optics and an optical link; and
- a rolling-pitching system having a rolling frame and a pitching frame for aligning at least said entrance optics with the object, said detector unit fastened on said rolling frame such that said detector unit conjointly rolls with said rolling frame in relation to said outer casing.

2. The seeker head according to claim 1, further comprising a cooler for cooling said matrix detector, said cooler is disposed rigidly in relation to said outer casing.

3. The seeker head according to claim 2, wherein said cooler is a gas cooler having a gas outlet, which is coaxial to a rolling axis and aligned with said detector unit.

4. The seeker head according to claim 1, further comprising a communications unit having a transmitter fixed to said rolling frame and a receiver fixed to said outer casing for wireless data transmission between said transmitter and said receiver.

5. The seeker head according to claim 1, further comprising a rolling sensor disposed fixed to said rolling frame for detecting a rolling movement of said rolling frame.

6. The seeker head according to claim 1, further comprising a movement sensor disposed fixed to said outer casing for detecting a movement of said outer casing.

7. A method for depicting an object of an object scene on a matrix detector of a seeker head for a guided missile, which comprises the steps of:
- aligning entrance optics of an optical system of the seeker head with the object with an aid of a rolling-pitching system, the rolling-pitching system having a rolling frame and a pitching frame, the object being depicted on the matrix detector by the optical system;
- rolling an outer casing of the seeker head in relation to the object scene surrounding it about a rolling axis; and
- rotating the matrix detector in relation to the outer casing and the matrix detector rolls conjointly with the rolling frame.

8. The method according to claim 7, wherein the matrix detector is steady in space and a depiction on the matrix detector is steady while the outer casing is rolling about the rolling axis, a steadiness of the matrix detector in space, that is an elimination of an absolute rolling movement, is achieved by driving the rolling frame counter to a rolling direction of the outer casing.

9. The method according to claim 7, which further comprises spraying a cooling gas from a cooler of the seeker head that is fixed to the outer casing against a detector unit that has the matrix detector and turns in relation to the cooler about the rolling axis and consequently the matrix detector is cooled.

10. The method according to claim 7, which further comprises detecting a rolling rate of the rolling frame by a rolling sensor disposed fixed to the rolling frame and a rolling rate is controlled in a closed-loop manner to a desired rolling value with an aid of data from the rolling sensor.

11. The method according to claim 10, which further comprises detecting a rolling movement that is produced by a tracking of the object by the entrance optics with an aid of a rolling sensor.

12. The method according to claim 11, which further comprises controlling a rolling drive such that the rolling rate of the rolling frame is controlled in the closed-loop manner to the desired rolling value with an aid of the rolling movement activated for the tracking of the object and with the aid of the data of the rolling sensor.

13. The method according to claim 7, which further comprises:

determining a rolling rate of the outer casing with an aid of a movement sensor fixed to the outer casing, and with an aid of a determined value a rolling drive is activated, so that the rolling frame is rotated in relation to the outer casing counter to its rotational rolling direction; and detecting a residual rolling rate of the rolling frame with an aid of a rolling sensor disposed fixed in the rolling frame and the rolling rate is controlled in a closed-loop manner to a desired rolling value with an aid of data from of the rolling sensor.

14. The method according to claim 13, wherein when controlling the rolling rate to the desired rolling value, a measuring error of the rolling sensor in the form of a drift is at least partially detected with an aid of the movement sensor and taken into account.

15. The method according to claim 7, which further comprises controlling a rolling rate of the rolling frame in a closed-loop manner to a desired rolling value with an aid of data obtained from a depiction of the object scene on the matrix detector.

* * * * *